US005648656A

United States Patent [19]

Begemann et al.

[11] Patent Number: 5,648,656

[45] Date of Patent: Jul. 15, 1997

[54] SYSTEM TO OPTIMIZE ARTIFICIAL LIGHTING LEVELS WITH INCREASING DAYLIGHT LEVEL

[75] Inventors: Simon H.A. Begemann; Gerrit J. Van Den Beld; Ariadne D. Tenner, all of Eindhoven, Netherlands

[73] Assignee: U.S. Philips Corporation, New York, N.Y.

[21] Appl. No.: 556,364

[22] Filed: Nov. 13, 1995

[30] Foreign Application Priority Data

Nov. 11, 1994 [EP] European Pat. Off. ..... 94203297

[51] Int. Cl.[6] ..... H01J 40/14

[52] U.S. Cl. ..... 250/214 AL; 315/150; 160/5

[58] Field of Search ..... 250/214 AL, 214 C, 250/214 R, 205; 315/149, 150, 152, 153, 154, 155, 156, 157, 158, 159, DIG. 4; 160/5, 1

[56] References Cited

U.S. PATENT DOCUMENTS

| | | | |
|---|---|---|---|
| 4,233,545 | 11/1980 | Webster et al. | 250/214 AL |
| 4,236,101 | 11/1980 | Lachaco | 250/214 AL |
| 4,247,766 | 1/1981 | Warren et al. | 250/214 AL |
| 4,273,999 | 6/1981 | Pierpoint | 250/214 AL |
| 4,368,406 | 1/1983 | Kruzich et al. | 250/214 AL |
| 5,163,426 | 11/1992 | Czeisler et al. | 128/395 |
| 5,237,168 | 8/1993 | Giust et al. | 250/214 AL |
| 5,237,169 | 8/1993 | Grehant | 250/214 AL |
| 5,250,799 | 10/1993 | Werner | 250/214 |
| 5,532,560 | 7/1996 | Element et al. | 318/266 |

FOREIGN PATENT DOCUMENTS 0410484 1/1991 European Pat. Off. .

OTHER PUBLICATIONS

"Interior Lighting" De Boer en Fischer, Second Edition, Philips Technical Library, Kluwer Technische Boeken, Deventer–Antwerpen 1981, pp. 60–63.

*Primary Examiner*—Edward P. Westin
*Assistant Examiner*—John R. Lee

[57] ABSTRACT

An artificial lighting system comprises a daylight sensor for sensing a level of daylight, artificial light source means for providing a level of artificial light, daylight control means for control of the level of daylight and a controller for control of the level of artificial light dependent on the sensed level of daylight. The controller decreases the level of artificial light with increasing level of daylight when the sensed daylight level is below a threshold, and reduces the amount of daylight through control of the daylight control means when the sensed daylight level is above the threshold.

4 Claims, 2 Drawing Sheets

SYSTEM TO OPTIMIZE ARTIFICIAL LIGHTING LEVELS WITH INCREASING DAYLIGHT LEVEL

FIELD OF THE INVENTION

The invention relates to an artificial lighting system comprising a daylight sensor for sensing a level of daylight, artificial light source means for providing a level of artificial light, and a controller for control of the level of artificial light depending on the sensed level of daylight. The invention further relates to a method of controlling a level of artificial light in dependence on a sensed level of daylight.

BACKGROUND ART

Artificial lighting systems of the type specified in the preamble are widely used, particularly in buildings. In order to provide an adequate lighting level in the environment controlled, the controller is operative to turn on the light source when the sensor detects that the daylight level has dropped below a pre-determined threshold, or in the opposite case, to turn off or dim the artificial lighting when the daylight level exceeds a predetermined threshold.

Apart from the obvious ergonomic aspects involved in adequate lighting of an environment, the lighting level also affects the human physiology. It is well known that the human physiological system is regulated by a mechanism that is commonly referred to as a biological clock. A plurality of physiological functions show a periodicity with a cycle of 24 hours. This repetitive behaviour is also called a circadian rhythm. It also is well known that lighting can dramatically affect this circadian rhythm. The mood and behaviour of an individual thus turn out to show a dependence on environmental lighting. Lighting optimized with regard to a person's preferences is found to contribute in a positive way to his or her sense of well-being and, hence, to his or her performance or behaviour. See, for example, U.S. Pat. No. 5,163,426.

"Interior Lighting", De Boer en Fischer, Second Edition, Philips Technical Library, Kluwer Technische Boeken, Deventer - Antwerpen, 1981, pp. 60–63 suggests that the level of permanent artificial lighting, which is necessary to give an acceptable brightness balance between the levels of artificial lighting and of daylight, is directly proportional to the level of exterior daylight. If the brightness balance is neglected, an object seen against a bright background is thrown into silhouette which is considered undesirable.

European patent application EP-A 0 410 484 discloses an artificial lighting system wherein, within a certain range of daylight levels, the level of artificial lighting is made substantially proportional to the level of the daylight entering into the room. Varying the artificial lighting in this manner is done for the same reason as above, namely, to avoid silhouettes.

OBJECT OF THE INVENTION

The above serves to emphasize the importance of regulating the aggregate lighting level stemming from daylight and artificial lighting sources combined, and in particular of the control of lighting systems in domestic environments, offices, plants, public buildings and places, hospitals, ocean liners, aircraft, etc.

It is an object of the invention to provide a lighting system as specified in the preamble that takes into account human preferences and that is economical in use.

SUMMARY OF THE INVENTION

To this end, the system in the invention is characterized by the following features. The system comprises daylight control means, e.g., blinds or window panes with controllably variable transparency, for control of the amount of daylight. Further, the controller is operative to decrease the level of artificial light with increasing level of daylight sensed by the daylight sensor when the level of daylight is below a pre-determined threshold and to reduce the amount of daylight through control of the daylight control means when the level of daylight is above the pre-determined threshold.

The invention is based on experiments wherein test persons in an office environment were asked to set the artificial lighting in such a way that it supplemented the available daylight to their optimum satisfaction considering the tasks that they were performing. The criteria on which the test persons adjusted their lighting in practice took into account the balancing of task related visual performance (reading/writing) with overall visual comfort and ambience (space related). Despite the fact that most of the time the daylight desk illuminance was well above the 500 lux level specified in many office lighting standards, the test persons were found to add artificial light even with daylight levels on the horizontal working plane, e.g., a desk, in the 2000 lux range. Blinds placed in front of the window could be used to reduce daylight levels in the room by 20–50% for a "view out". On overcast days the added artificial lighting level stays roughly constant around 1000 lux with increasing daylight levels. On clear days a decrease in added artificial lighting level from 1200 to 500 lux occurs with an increasing daylight level up to 2000 lux. However, when the daylight level increases above a threshold of 2000 lux the added artificial light increases in the situation without blinds but decreases with blinds. On mixed days a similar pattern occurs as on clear days with on average higher artificial lighting levels.

In other words, experiments show that when the blinds are used to reduce the brightness of the windows and hence the daylight level, less artificial light is added than without blinds. This insight is used to optimize both energy consumption of the artificial lighting system and the sense of well-being of persons in the controlled space.

DESCRIPTION OF THE DRAWING

The invention is explained by way of example and with reference to the accompanying drawing, wherein.

DETAILED EMBODIMENTS

Figure 1:
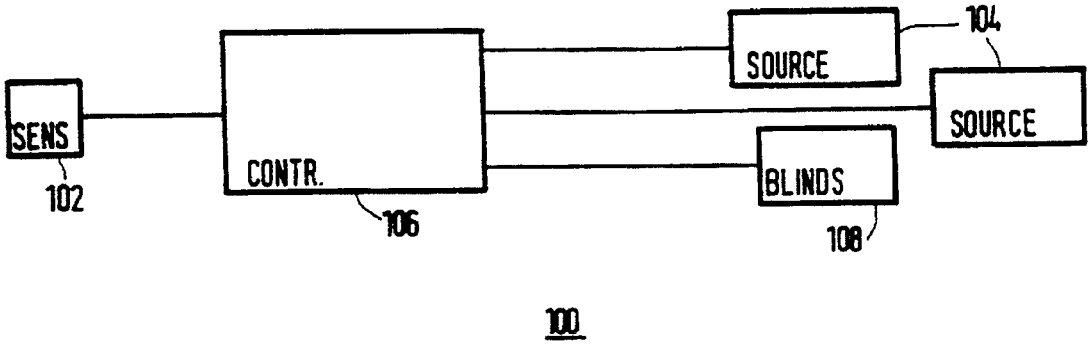
FIG. 1 is a block diagram of the system according to the invention.

FIG. 1 shows a block diagram of the system 100 in the present invention. In operational use, system 100 is installed in a space (not shown) to be occupied by a human being. System 100 comprises a daylight sensor 102 for sensing a level of daylight representative of the incident light through the windows (not shown). System 100 further includes one or more artificial light sources 104 for providing a level of artificial light on the relevant horizontal and vertical surfaces in the space, and a controller 106 for control of the level of artificial light dependent on the level of daylight sensed by sensor 102. System 100 also includes daylight control means 108, such as blinds or window panes with controllably variable transparency, to control the level of daylight entering the space controlled.

Controller 106 may be operative to decrease the level of artificial light with increasing level of daylight sensed by daylight sensor 102 when the sensed level of daylight is below a predetermined threshold and to increase the level of artificial light provided by artificial light sources 104 with increasing level of daylight sensed by daylight sensor 102, preferably when the sensed daylight level is larger than a threshold of substantially 2000 lux on the horizontal working plane. Alternatively or subsidiarily, controller 106 may be operative to reduce the amount of daylight entering the room through control of daylight control means 108 when the level of daylight is above the pre-determined threshold.

The combined control of the artificial lighting and the daylight in the manner specified above takes into account ergonomic aspects as well as energy consumption. Control is preferably achieved through a rule-based system. Preferably, controller 106 is programmable to enable the user to specify his or her preferences regarding the variation of the artificial light level with the daylight level, e.g., the rate of change, or the threshold or in dependence on the season. A rule-based system such as a fuzzy controller is highly suitable for use as a controller in the system of the present invention, as most people perceive lighting aspects better in qualitative than in quantitative terms. A fuzzy controller may thus help in gaining wide acceptance of the system in the invention owing to its user-friendliness. Further, the control may take into account various types of weather, e.g., overcast, partly cloudy, open sky, so as to adapt the control procedure to the character of the daylight. This also is preferably implemented using a fuzzy controller.

Figure 2:
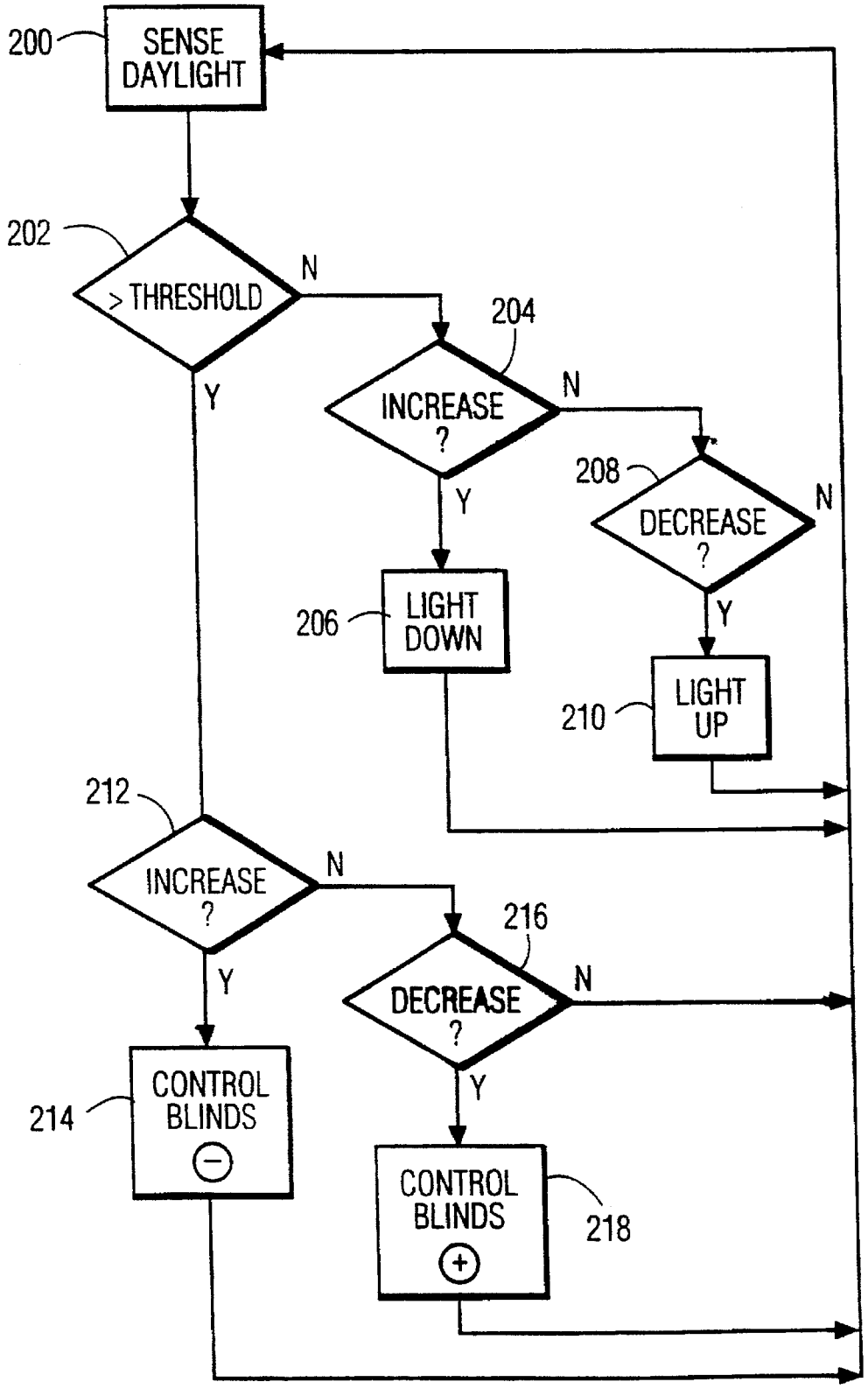
FIG. 2 is a flow diagram which illustrates the procedure of the invention.

FIG. 2 shows an example of a flow diagram to illustrate the procedure of the invention. In step 200, the daylight level is sensed. In step 202 it is determined whether the sensed daylight level is above threshold. If the sensed daylight level is not above the threshold, it is determined in step 204 whether or not the sensed daylight level is increasing. If the level is increasing then the artificial light level is reduced in step 206 whereupon the procedure returns to step 200. If the daylight level is not increasing it is determined in step 208 whether or not the daylight level is decreasing. If there is no decrease the procedure returns to step 200. If there is a decrease, the artificial light level is increased in step 210, whereupon the procedure returns to step 200. If the daylight level sensed is above the threshold, it is determined in step 212 if the level is increasing. If it is increasing, blinds 108 are controlled to reduce the entering daylight in step 214, whereupon the procedure returns to step 200. If the sensed daylight is not increasing, it is determined in step 216, whether or not it is decreasing. If it is not decreasing, the procedure returns to step 200. If the daylight level is decreasing, blinds 108 are controlled to let pass more daylight in step 218, whereupon the procedure returns to step 200.

We claim:

1. An artificial lighting system comprising:

a daylight sensor for sensing a level of daylight;

artificial light source means for providing a level of artificial light;

a controller for control of the level of artificial light depending on the sensed level of daylight;

characterized in that the system further comprises daylight control means for controlling the amount of daylight; and the controller is operative to decrease the level of artificial light with increasing level of daylight sensed by the daylight sensor when the level of daylight is below a pre-determined threshold and to reduce the amount of daylight through control of the daylight control means when the level of daylight is above the pre-determined threshold.

2. The system of claim 1, wherein the threshold depends on at least a type of the weather or a season.

3. The system of claim 1, wherein the threshold is user controllable.

4. A method of controlling an aggregate lighting level stemming from artificial light source means and from daylight, the method comprising:

sensing a level of daylight;

controlling the level of artificial light dependent on the sensed level of daylight, characterized in that the method further comprises:

decreasing the level of artificial light with increasing level of daylight when the sensed daylight level is below a pre-determined threshold; and reducing the amount of daylight through control of daylight control means when the sensed daylight level is above the pre-determined threshold.

* * * * *